US006030195A

United States Patent [19]

Pingston

[11] Patent Number: 6,030,195

[45] Date of Patent: Feb. 29, 2000

[54] ROTARY PUMP WITH HYDRAULIC VANE ACTUATION

[75] Inventor: Ted A. Pingston, Kalamazoo, Mich.

[73] Assignee: Delaware Capital Formation Inc., Wilmington, Del.

[21] Appl. No.: 08/903,072

[22] Filed: Jul. 30, 1997

[51] Int. Cl.[7] ..... F04C 2/344

[52] U.S. Cl. ..... 418/82; 418/133; 418/268

[58] Field of Search ..... 418/82, 133, 268

[56] References Cited

U.S. PATENT DOCUMENTS

| | | | |
|---|---|---|---|
| 1,854,692 | 4/1932 | Cooper | 418/82 |
| 3,216,363 | 11/1965 | Snow et al. | 418/268 |
| 3,257,958 | 6/1966 | Adams et al. | 418/82 |
| 4,242,068 | 12/1980 | Shaw | 418/82 |
| 4,355,965 | 10/1982 | Lowther | 418/268 |
| 4,746,280 | 5/1988 | Wystemp et al. | 418/268 |
| 4,822,265 | 4/1989 | Johnson et al. | 418/182 |
| 4,913,636 | 4/1990 | Niemiec | 418/82 |
| 5,064,362 | 11/1991 | Hansen | 418/186 |
| 5,266,018 | 11/1993 | Niemiec | 418/82 |
| 5,807,090 | 9/1998 | Agner | 418/268 |

*Primary Examiner*—John J. Vrablik
*Attorney, Agent, or Firm*—Warner Norcross & Judd LLP

[57] ABSTRACT

A sliding vane rotary pump having fixed volume hydraulic vane actuation. The pump generally includes a rotor assembly rotatably positioned within a rotor chamber to define at least one pumping chamber. The pumping chamber is divided into a primary chamber and a secondary chamber. The axial walls of the rotor chamber define a plurality of transfer grooves and the rotor defines a plurality of rotor transfer holes. The rotor transfer holes and transfer grooves are arranged to provide a flow path from the secondary chamber to the vane slot of an extending vane each time a vane travels through the secondary chamber.

30 Claims, 10 Drawing Sheets

ROTARY PUMP WITH HYDRAULIC VANE ACTUATION

BACKGROUND OF THE INVENTION

The present invention relates to pumps, and more particularly, to a rotary vane pumps having hydraulic vane actuation.

Rotary pumps are widely used in industry. A conventional rotary vane pump includes a rotor assembly positioned within a rotor chamber. The rotor assembly includes a number of vanes spaced around the rotor to divide the rotor chamber into a series of discrete cavities. As the rotor assembly rotates, the vanes rotate following the wall of the rotor chamber, thereby causing the cavities to rotate around the rotor chamber. In a typical single-action rotary pump, the rotor is mounted concentrically within an eccentric rotor chamber, thereby defining a single pumping chamber. As a result of the eccentric alignment, the cavities expand and contract once during each rotation of the rotor assembly. In a double-action rotary pump, the rotor is mounted within an elliptical rotor chamber, thereby defining a pair of radially-opposed pumping chanbers. As a result, the cavities expand and contract twice during each revolution of the rotor assembly. An inlet communicates with the pumping chamber at a location where the cavities expand. Similarly, an outlet communicates with the pumping chamber at a location where the cavities contract. As each cavity expands, a partial vacuum is created which draws pumpage into the cavity through the inlet. As each cavity contracts, the pressure within the cavity increases, thereby forcing the pumpage out of the cavity through the outlet. The expansion and contraction process continues for each cavity to provide a continuous pumping action.

Sliding vane rotary pumps include generally straight vanes slidably fitted within radially extending slots formed in the rotor. As the rotor spins, centrifugal force urges the vanes out of the slots into contact with the wall of the rotor chamber. This outward force on the vanes is counteracted by a number of forces, including the viscosity of the pumpage and the friction between the vane and the vane slot. Often, the counteracting forces are large enough to cause the vanes to move slowly from or become stuck in the vane slots. This is particularly true when pumping highly viscous pumpage. In such cases, the vanes do not remain in firm contact with the wall of the rotor chamber and therefore pumpage is permitted to flow between adjacent cavities. This cause the pump to "slip," thereby losing some efficiency.

In an effort to overcome this problem, a number of methods have been developed to increase the outward force on the vanes. For example, a variety of pumps have been developed which utilize hydraulic pressure generated by the pump to increase the outward force on the vanes. In one such design, pumpage from the discharge is directed beneath the vanes to provide increased outward force on the vanes. In this design, the pump includes a flow passage that extends from the discharge outlet to the base of the vane slots. In theory, high pressure in the discharge outlet will force some of the pumpage to flow through the passage into the vane slots beneath the vanes, thereby increasing the outward force on the vanes. However, this type of design suffers from a number of disadvantages. First, this design typically provides constant outward pressure on the vanes-even when the vane should be retracting. As a result, this design typically cause increased wear. Second, the volume of pumpage that flows into the vane slots will vary depending on a number of factors including the characteristics of the pumpage (e.g. viscosity), the amount of resistance in the vane slot, and the amount of pressure developed within the discharge. As a result, the effectiveness of this type of design can vary significantly from application to application.

SUMMARY OF THE INVENTION

The aforementioned problems are overcome by the present invention which provides a rotary pump with fixed volume hydraulic vane actuation. The prefered embodiment provides a double-action pump having a rotor assembly rotatably positioned within a rotor chamber. The rotor chamber is defined by an elliptical liner and a pair of axial end walls. The elliptical shape of the liner and cylindrical shape of the rotor provide the pump which a pair of radially-opposed pumping chambers. Each pumping chamber defines a primary chamber and a secondary chamber. The axial end walls define a plurality of transfer grooves and the rotor defines a plurality of rotor transfer holes. The rotor transfer holes and transfer grooves are positioned to selectively provide a flow path from the secondary chamber to the base of the vane slot of an extending vane.

As a vane travels through the primary chamber, it seals off its leading cavity and draws pumpage into its trailing cavity. As the vane continues to travel through the primary chamber, the leading cavity begins to collapse forcing the pumpage contained therein to exit through the discharge. Eventually, the vane travels past the discharge into the secondary chamber thereby sealing the leading cavity from the discharge. Simultaneously, the rotor transfer holes of the leading cavity come into communication with the transfer grooves and the transfer grooves come into communication with the base of the vane slot of an extending vane. As the vane continues to travel, the leading cavity continues to collapse forcing pumpage out of the secondary pumping chamber through the rotor transfer holes and the transfer grooves into the base of the vane slot of the extending vane. Accordingly, a fixed volume of pumpage corresponding to the volume of the secondary chamber is forced into the base of the vane slot of the extending vane.

Fixed volume hydraulic vane actuation provides the rotary pump of the present invention with increased efficiency over a wide variety of operating conditions. The amount of outward force on the extending vanes can be controlled by varying the volume of the secondary chamber. Preferably, the pump will be designed so that the volume of the secondary chamber is equal to or exceeds the volume of the void in the vane slot beneath a fully extended vane.

In addition, the rotor transfer holes are preferably arranged to direct pumpage out of the axial ends of the rotor. This opposed axial flow of pumpage generates hydrostatic pressure that helps to axially center the rotor assembly within the rotor chamber.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
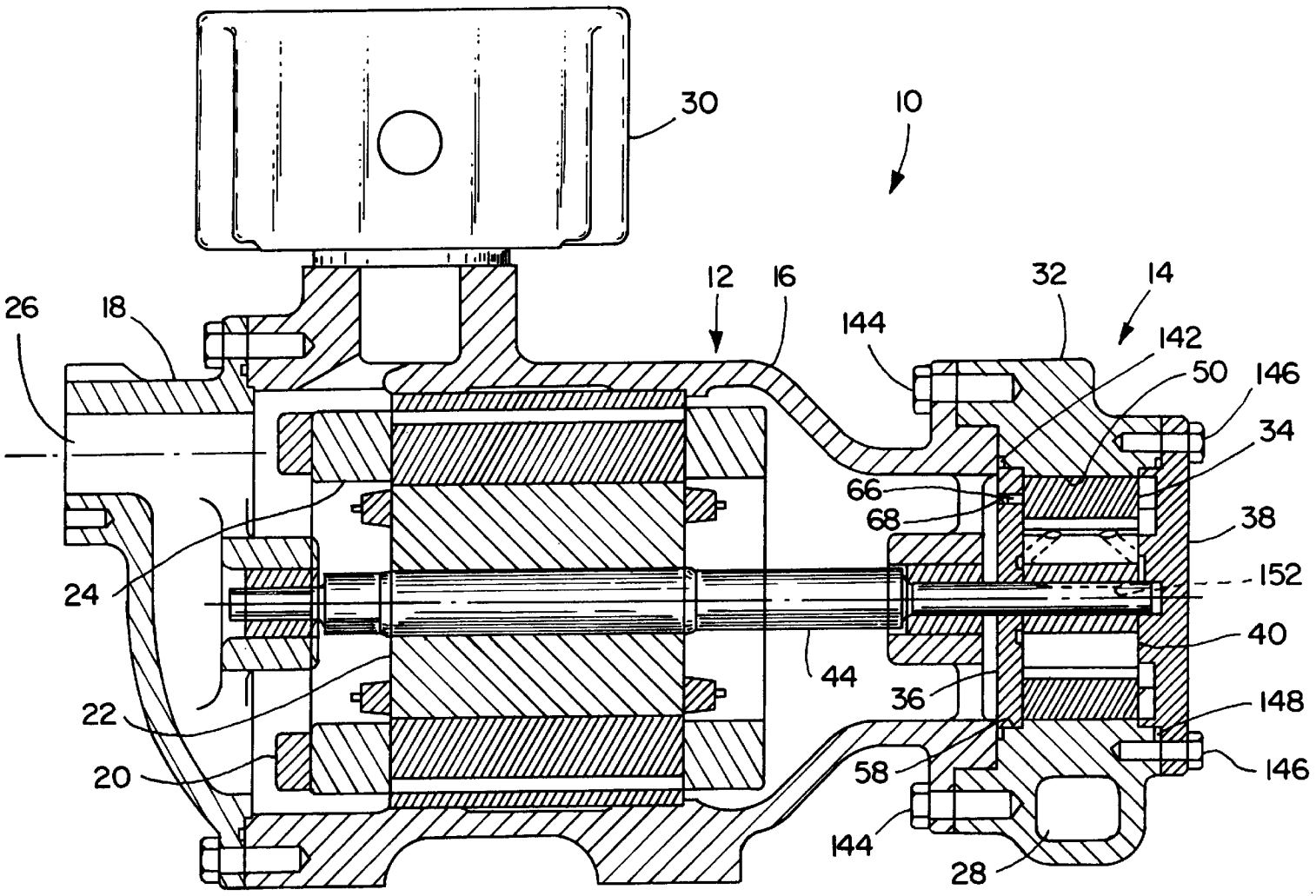
FIG. 1 is a sectional side elevational view of a pump incorporating the principles of the present invention.

A sliding vane rotary pump according to a preferred embodiment of the invention is illustrated in FIG. 1 and generally designated 10. By way of disclosure, and not by way of limitation, the present invention is described in conjunction with a semi-hermetically sealed, double chamber pump having an internal drive motor. The described pump is designed for use in pumping liquefied gases. The present invention is, however, in no way limited to such applications. Those skilled in the art will readily appreciate and understand that the present invention is well-suited for use with virtually any sliding vane rotary pump designed to pump virtually any type of pumpage. For example, it will readily be appreciated that the present invention is well-suited for use with single chamber pumps and with externally driven pumps.

In general, pump 10 includes a drive portion 12 and a pump portion 14. The drive portion 12 includes a motor housing 16 and a motor housing end bell 18 that house a conventional motor assembly 20. The motor assembly 20 includes a motor rotor 22 and a motor stator 24, and operates in a conventional manner to drive the pump 10. The drive portion also includes an electrical housing 30 through which power is supplied to the motor assembly 20. In operation, the motor assembly 20 drives the pump 10 causing pumpage to enter the pump portion 14 through the pump inlet 28, flow from the pump portion 14 through the interior of the motor housing 16, and then out of the pump 10 through the pump discharge 26. Conventional input and output lines (not shown) are connected to the pump inlet 28 and pump discharge 26 to convey the pumpage. When the pump operates, pumpage is drawn into the pump through the input line and forced out of the pump through the output line. The motor portion 12 can be replaced by virtually any rotary drive mechanism, including an external drive assembly such as an electric or hydraulic motor and pulley assembly (not shown).

Figure 2:
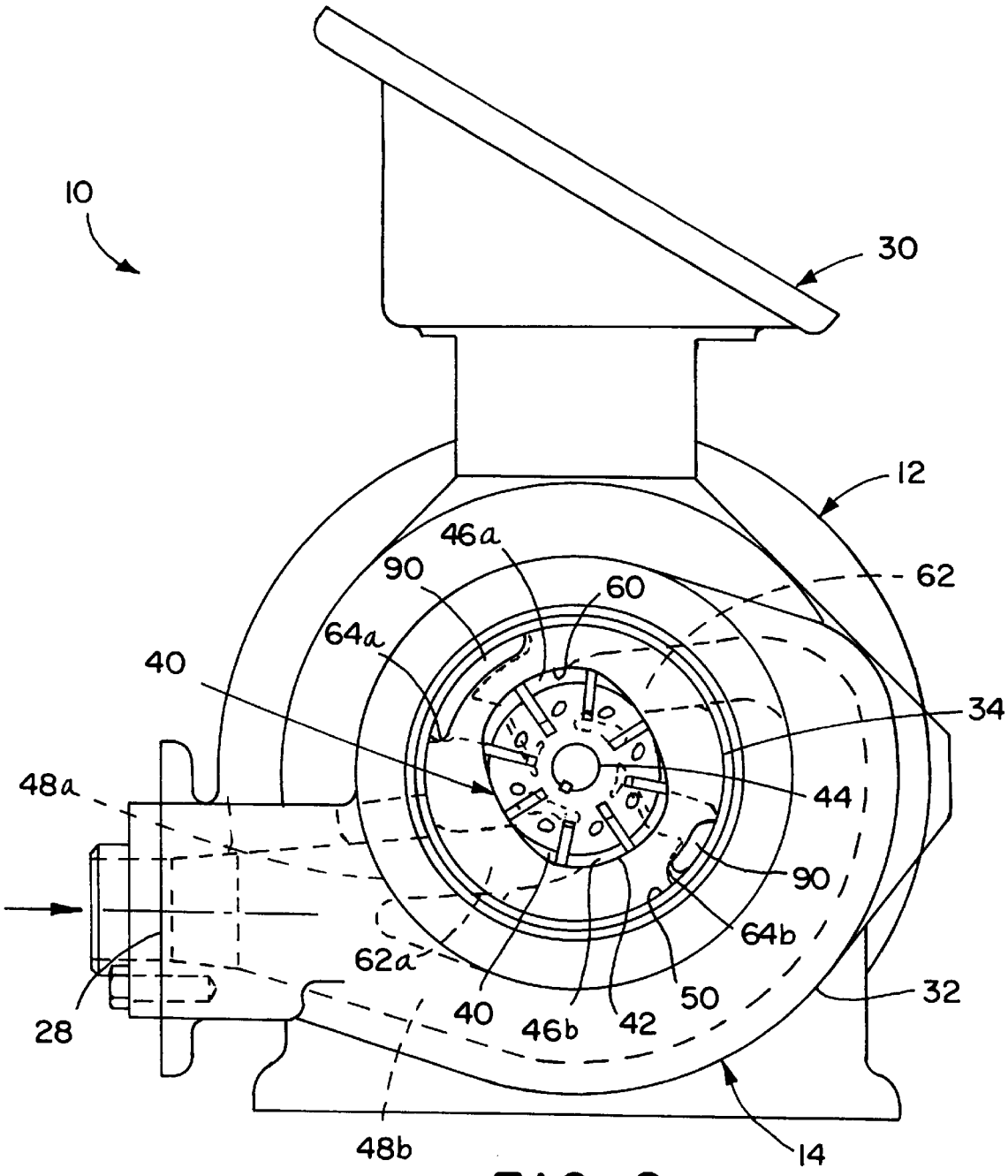
FIG. 2 is a front elevational view of the pump with the outboard head removed.

The pump portion 14 generally includes an outboard head 38, a pump casing 32, a liner 34, a rotor assembly 40, and an inboard disc 36. The pump casing 32 is mounted directly to the motor housing 16, and the outboard head 38 is mounted directly to the pump casing 32 (See FIG. 1). In addition, the inboard disc 36 is positioned between the pump casing 32 and the motor housing 16, and the liner 34 is mounted within the pump casing 32 between inboard disc 36 and outboard head 38 (See FIG. 3). The liner 34, inboard disc 36, and outboard head 38 cooperatively define an elliptical rotor chamber 42 (See FIG. 2). The rotor assembly 40 is rotatably mounted within the rotor chamber 42 and divides the rotor chamber 42 into a pair of radially opposed pumping chambers 46*a* and 46*b*. The rotor assembly 40 is operatively connected to the motor shaft 44 such that rotation of the motor shaft 44 results in rotation of the rotor assembly 40. Obviously, the rotor assembly 40 can be operatively connected to the shaft of virtually any rotary drive assembly, including an external drive assembly such as an electric or hydraulic motor and pulley assembly (not shown) or magnet torque coupling.

Figure 3:
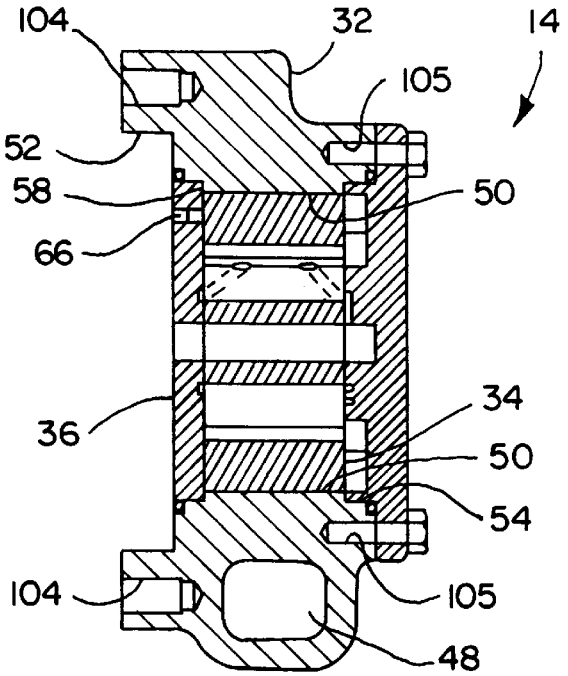
FIG. 3 is a sectional side elevational view of the pump portion.
Figure 4:
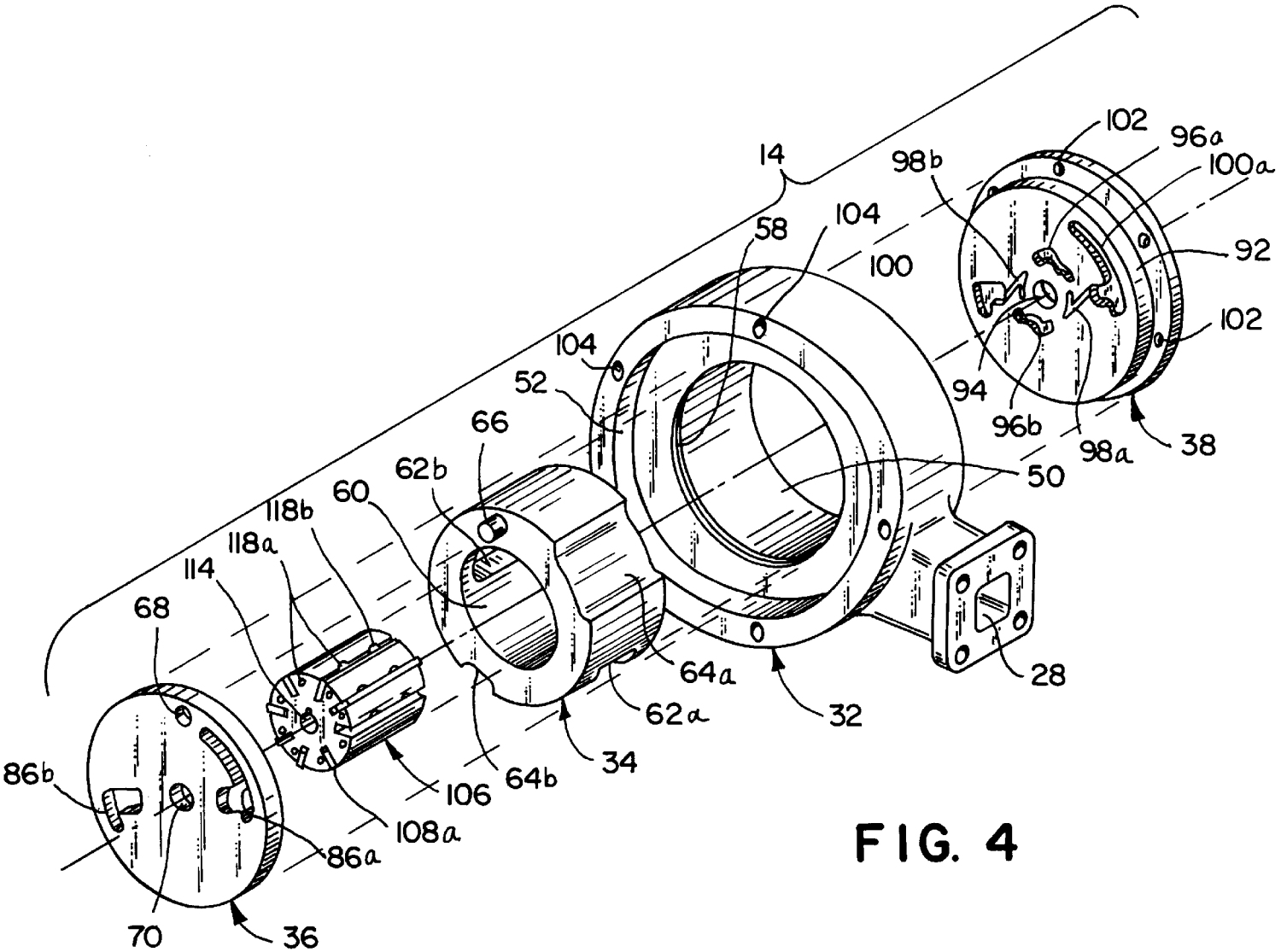
FIG. 4 is an exploded perspective view of the pump portion.
Figure 5:
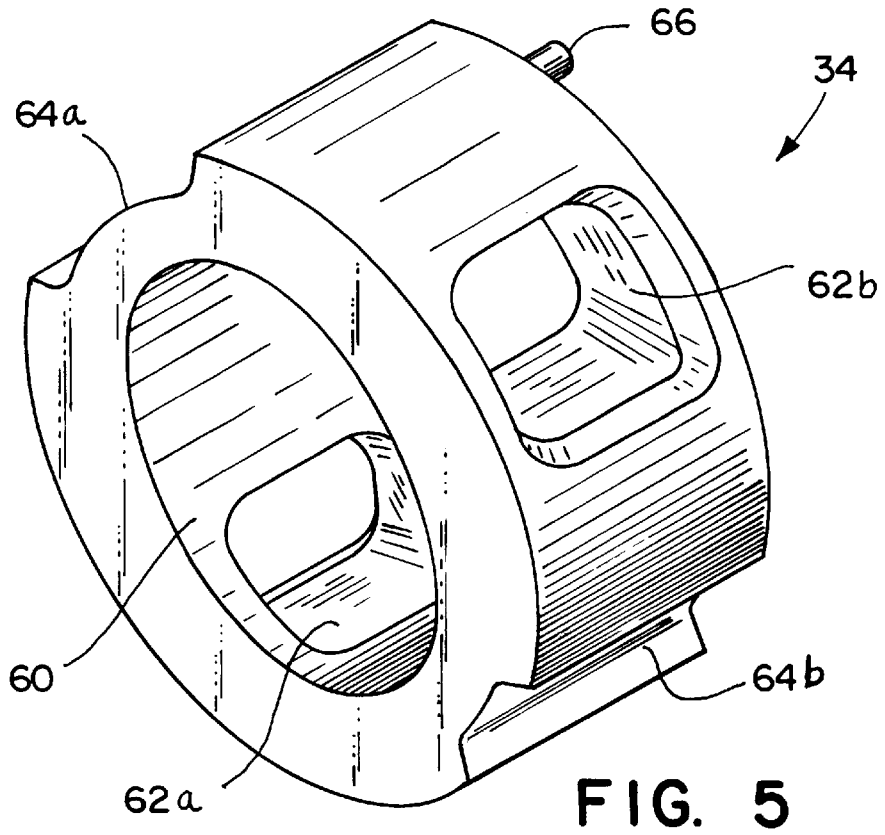
FIG. 5 is a perspective view of the liner.
Figure 6:
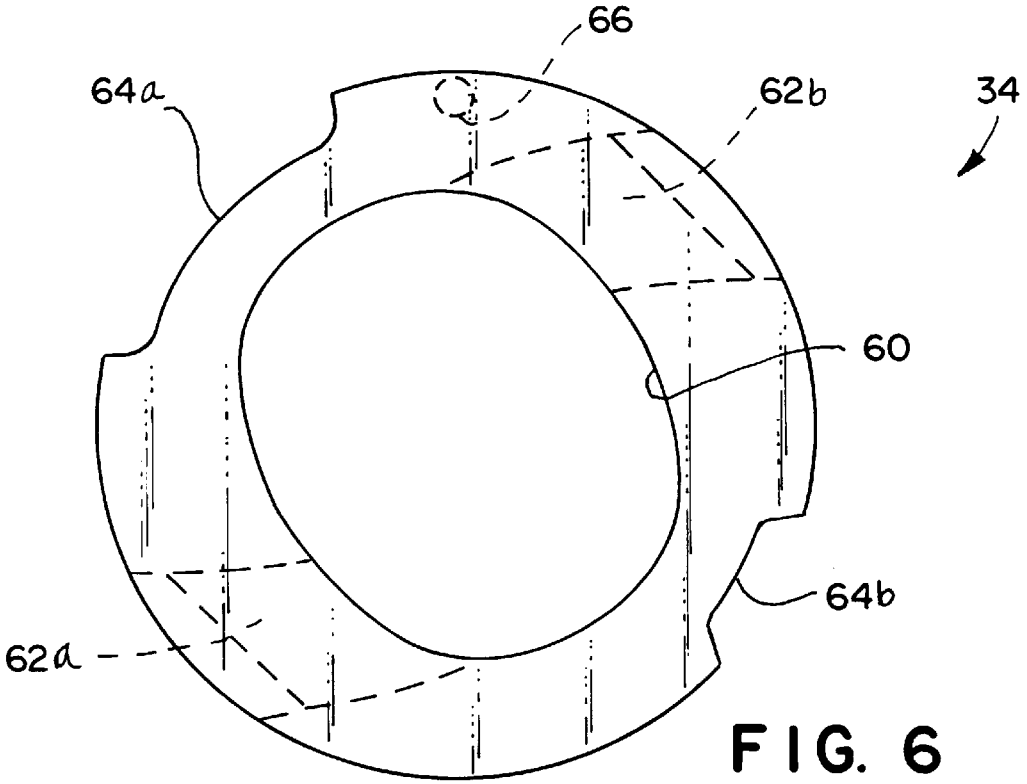
FIG. 6 is a top plan view of the liner.
Figure 7:
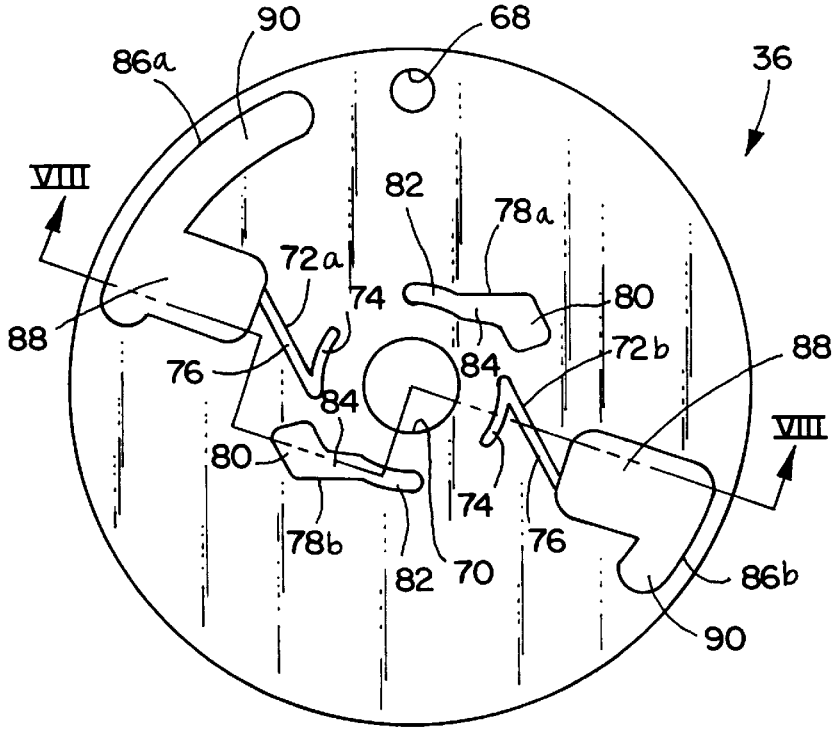
FIG. 7 is a top plan view of the inboard disc.
Figure 8:
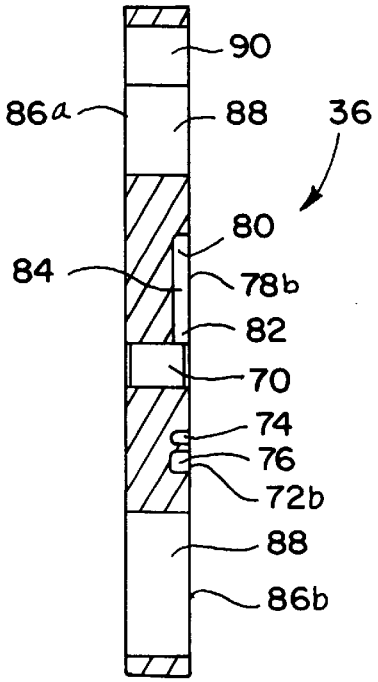
FIG. 8 is a sectional view of the inboard disc taken along line VIII—VIII of FIG. 7.

The pump casing 32 defines a cylindrical void 50 adapted to receive the liner 34 as well as a pair of mounting recesses 52 and 54 located at opposite axial ends of the void 50 (See FIGS. 3 and 4). Mounting recess 52 interfaces with the motor housing 16 and mounting recess 54 interfaces with the outboard head 38. The pump casing 32 also defines an inboard disc recess 58 that seats the inboard disc 36 and inlet passage 48*a–b* that splits to feed pumpage from the pump inlet 28 to radially opposed sides of the liner 34. The pump casing 32 also defines a plurality of mounting holes 104 for securing the pump casing 32 to the motor housing 16 and a plurality of mounting holes 105 for securing the outboard head 38 to the pump casing 32. If desired, the pump casing 32 may include a conventional pressure relief assembly (not shown) or other conventional accessories.

The liner 34 is seated within pump casing void 50 between the inboard disc 36 and the outboard head 38. The liner 34 defines an elliptical rotor chamber 60 which rotatably receives the rotor assembly 40. As noted above, the rotor assembly 40 divides the rotor chamber 60 into two radially opposed pumping chambers 46*a–b* (See FIGS. 2, 17 and 18). The liner 34 further defines a pair of radial flow passages 62*a–b* which interconnect the inlet passages 48*a–b* with the pumping chambers 46*a–b*, respectively, and a pair of axial flow passages 64*a–b* which allow fluid discharged from the outboard end of the rotor assembly 40 to flow axial to the inboard end of the rotor assembly 40. The liner 34 includes a cylindrical key 66 that extends axially from the inboard end of the liner 34. The key 66 is fitted within a circular key opening 68 in the inboard disc 36 to align the disc in the correct clocking position. The liner is retained in the casing by an interference fit with the casing bore.

The inboard disc 36 is sandwiched between the pump casing 32 and the motor housing 16 within inboard disc recess 58. The inboard disc 36 is generally circular and defines a circular key opening 68 and a concentric, circular shaft opening 70. Both of these openings 68 and 70 extend entirely through the disc 36. The inboard disc 36 also defines a pair of vent grooves 72*a–b* which, as described below, create a flow path that permits pumpage to vent from the vane slots when the vanes retract. The vent grooves 72*a–b* are positioned on radially opposed sides of the disc 36 and each includes an arcuate segment 74 and a linear segment 76 that extends at an angle to the arcuate segment 74. The inboard disc 36 also defines a pair of transfer grooves 78*a–b* which, as described below, create a portion of a flow path that permits pumpage to flow from the secondary pumping chamber to the base of the vane slot of an extending vane. The transfer grooves 78*a–b* each include an inlet portion 80 and an outlet portion 82 that are radially offset from each other and interconnected by a central portion 84. The vent grooves 72*a–b* and transfer grooves 78*a–b* are recessed into the surface of the inboard disc 36 and do not extend entirely therethrough. And finally, the inboard disc 36 defines a pair of discharge openings 86*a–b* that create an exit flow path from the pumping chambers 46*a–b* to the interior of the motor housing 16. As noted above, the motor housing 16, in turn, defines an exit flow path to the pump discharge 26 in the end bell 18. The discharge openings 86*a–b* extend entirely through the inboard disc 36 and include a radial portion 88 that communicates with the pumping chambers 46*a–b* and the vent grooves 72*a–b*, and an arcuate portion 90 that communicates with the interior of the motor housing 16 and the axial flow passages 64*a–b* of the liner 34.

The outboard head 38 is generally circular and is mounted directly to the pump casing 32. The inboard surface of the outboard head 38 includes a raised circular portion 92 that is fitted within mounting recess 54. The raised circular portion 92 is similar in dimension to the inboard disc 36 and includes similar features. More specifically, the portion 92 defines a concentric circular shaft recess 94 that rotatably receives the end of the shaft 44 as well as a pair of transfer grooves 96*a–b*, a pair of vent grooves 98*a–b*, and a pair of discharge grooves 100*a–b* that function in the same manner as those of the inboard disc 36. The transfer grooves 96*a–b*, vent grooves 98*a–b*, and discharge grooves 100*a–b* are essentially the mirror image of those of the inboard disc 36 and are axially aligned therewith. The discharge grooves 100*a–b* differ from the discharge openings 86*a–b* of the inboard disc 36 in that they do not extend entirely through the outboard head 92. Rather, the discharge grooves 100*a–b* define an exit flow path from the pumping chambers 46*a–b* and vent grooves 98*a–b* to the axial flow passages 64*a–b* in the liner 34. The pumpage flows from the axial flow passages 64*a–b* to the pump discharge 26 through the arcuate portion 90 of the discharge opening 86*a–b* and the interior of the motor housing 16. The outboard head 38 also defines a plurality of mounting holes 102 for securing the outboard head 38 to the pump casing 32.

Figure 11:
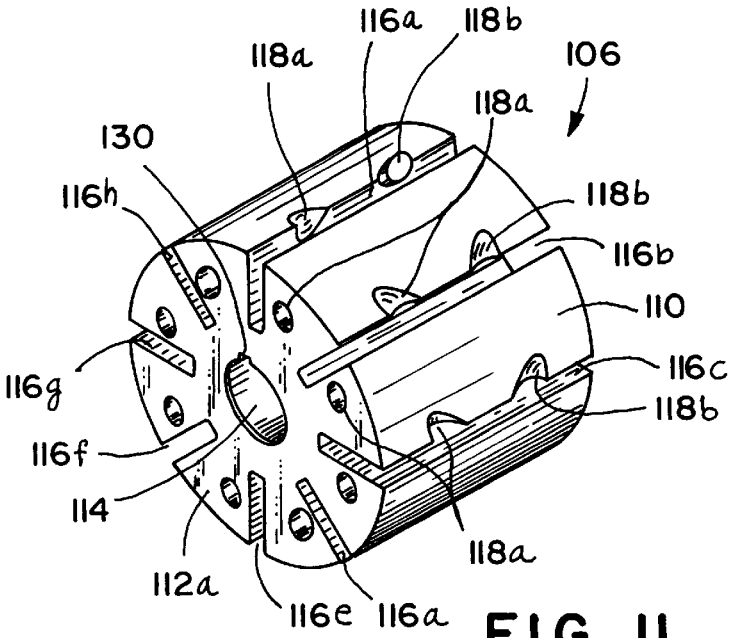
FIG. 11 is a perspective view of the rotor.
Figure 9:
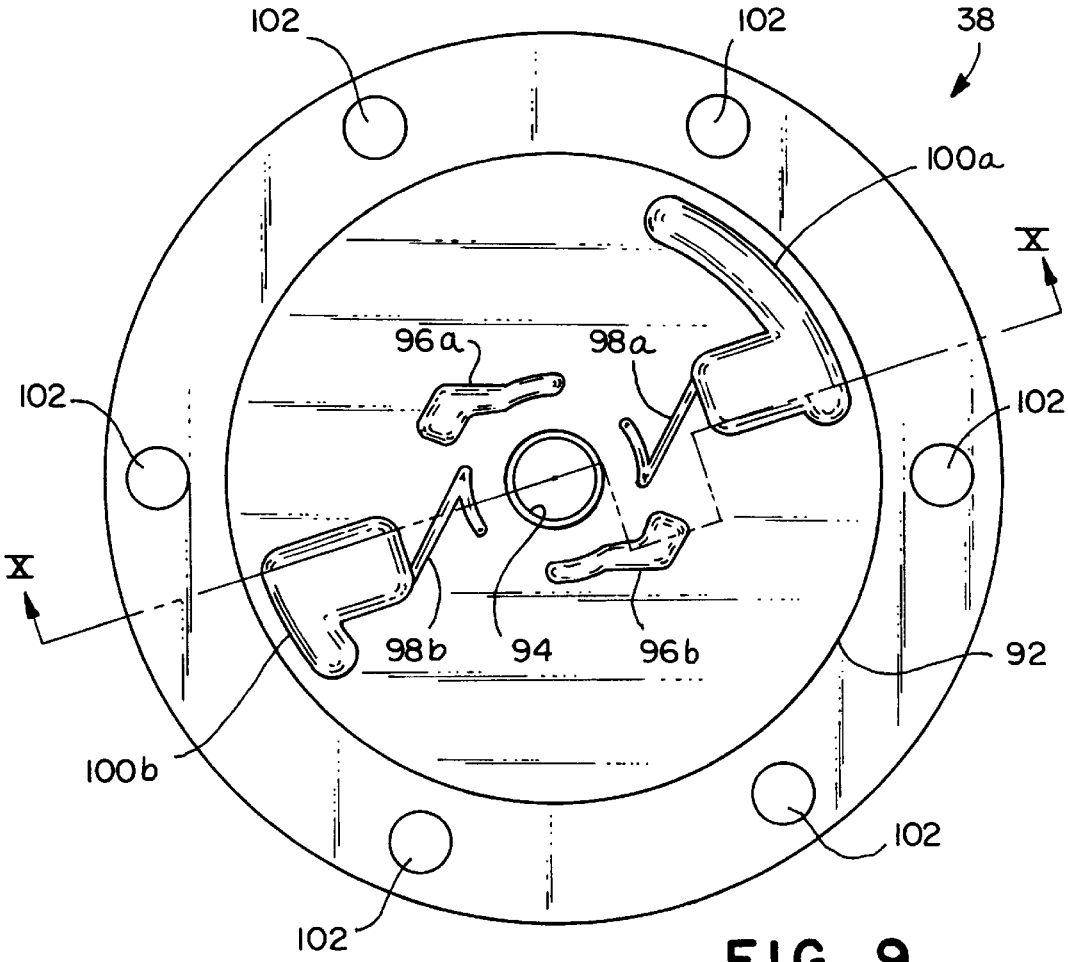
FIG. 9 is a bottom plan view of the outboard head.
Figure 10:
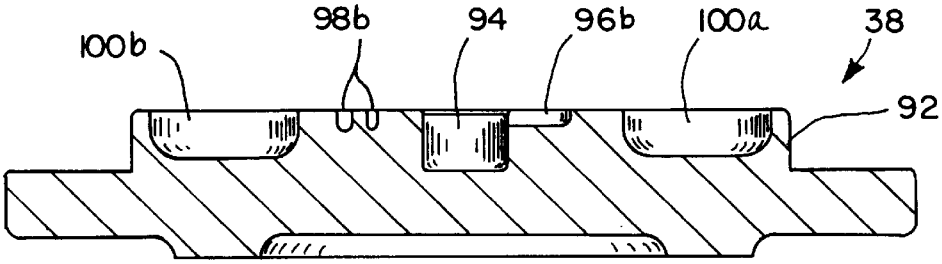
FIG. 10 is a sectional view of the outboard head taken along line X—X of FIG. 9.
Figure 12:
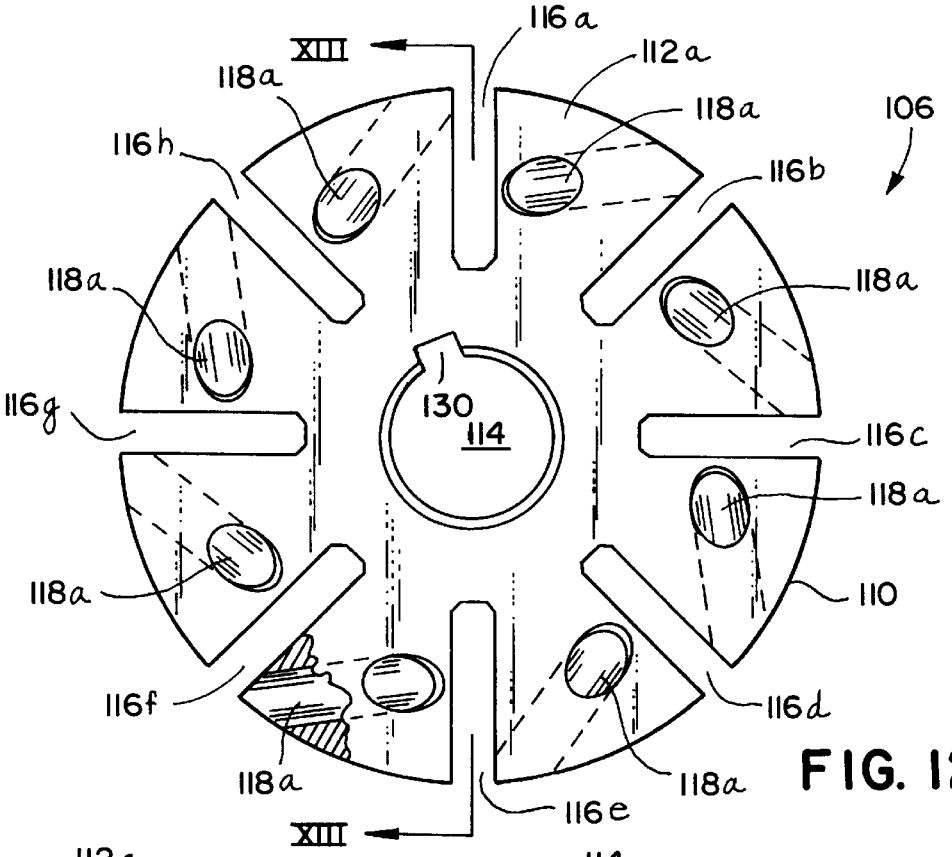
FIG. 12 is a top plan view of the rotor.
Figure 13:
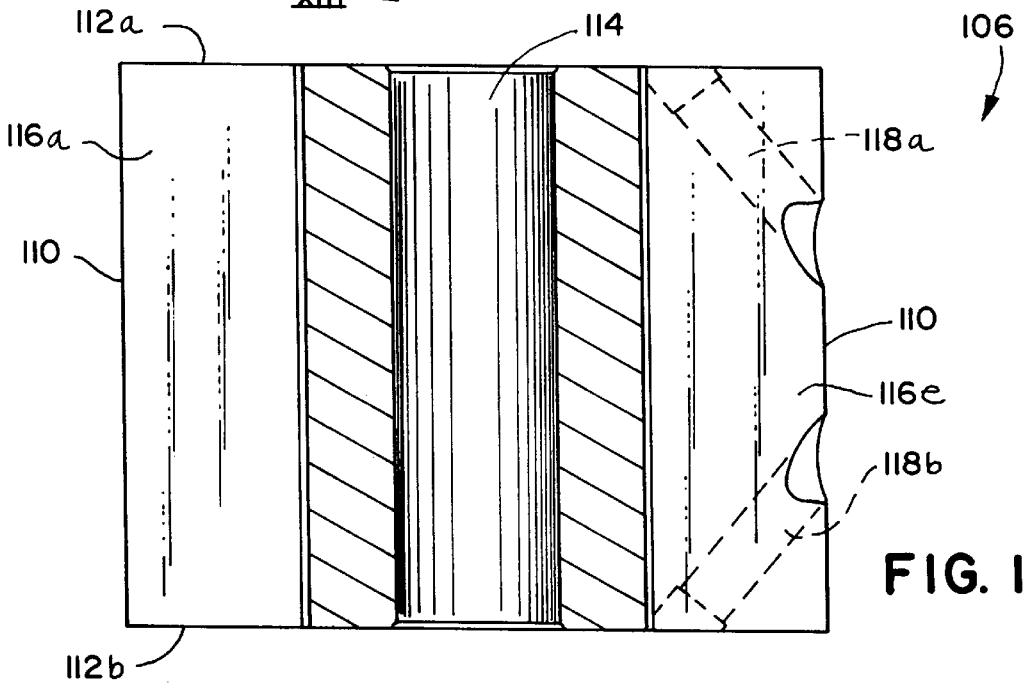
FIG. 13 is a sectional view of the rotor taken along line XIII—XIII of FIG. 12.

As noted above, the rotor assembly 40 is rotatably seated within the rotor chamber 42. The rotor assembly 40 generally includes a rotor 106 and a plurality of vanes 108*a–h* (See FIGS. 17 and 18). Referring now to FIGS. 11–13, the rotor 106 is preferably a one-piece machined component that is fitted over shaft 44. The rotor 106 is generally cylindrical and includes an outer surface 110 and a pair of opposed axial end surfaces 112*a–b*. Rotor 106 defines a concentric, longitudinal bore 114 to slidably fit over shaft 44 and a plurality of eight radially symmetric vane slots 116*a–h* to seat vanes 108*a–h*. The number and dimensions of the vane slots 116*a–h* will vary depending on the design of the pump and the shape of the vanes. However, in a preferred embodiment, each vane slot 116*a–h* includes a generally rectangular void defined along a radius of the rotor and extending entirely through the rotor 106 in an axial direction. A pair of rotor transfer holes 118*a–b* extend from the intersection of each vane slot 116*a–h* and the outer surface 10 to opposite axial end surfaces 112 of the rotor 106. The rotor transfer holes 118*a–b* create a flow path that, when in the appropriate position, permits pumpage to flow from the secondary pumping chambers 140*a–b* to the transfer grooves 78*a–b* and 96*a–b*. The rotor 106 also defines an axially extending keyway 130 for keying the rotor 106 to the shaft 44. When keyed to the shaft 44, the rotor 106 is free to float axially along the shaft 44 within the rotor chamber 42.

Figure 15:
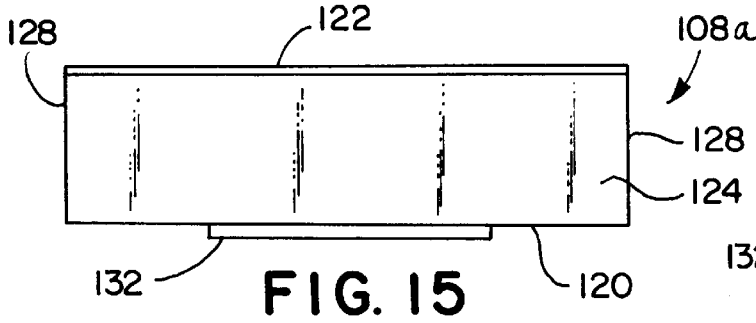
FIG. 15 is a side elevational view of a vane.
Figure 16:
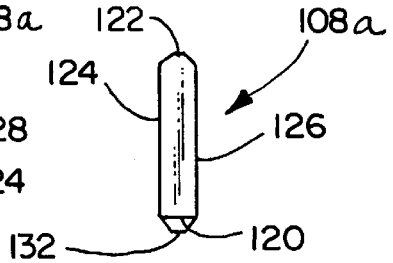
FIG. 16 is an end elevational view of a vane.
Figure 14:
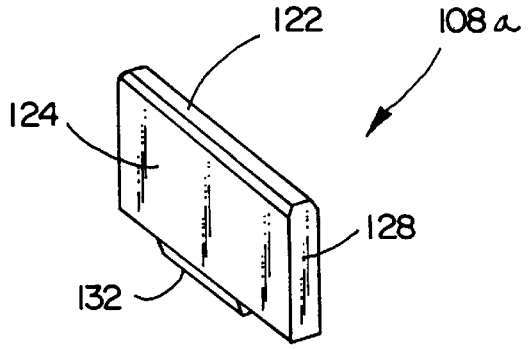
FIG. 14 is a perspective view of a vane.

Referring now to FIGS. 14–16, each vane 108*a–h* is generally rectangular and includes an inner surface 120, an outer surface 122, a front surface 124, a back surface 126, and a pair of end surfaces 128. A protrusion 132 extends from the inner surface 120 of each vane 108*a–h*. The protrusion 132 functions as a stop to provide a gap 134 between the bottom of the vane and the base of the vane slot (See FIGS. 17 and 18). The gap 134 permits pumpage to flow into the vane slot even when the vane is fully retracted. The longitudinal edges of the protrusion 132 are angled to permit pumpage to flow across the entire base of the vane slot and allows the vane to seal across the vane slot. The outer surface 122 of each vane 108*a–h* is shaped to follow the inner surface of the liner 34. More specifically, the longitudinal edges of the outer surface 122 are angled as shown in FIG. 16.

MANUFACTURE AND ASSEMBLY

Pump 10 is manufactured and assembled a generally conventional manner. The various components of the pump are manufactured using conventional methods, such as casting or machining, or are purchased from well known suppliers. As noted above, the described drive portion 12 of the pump 10 is merely exemplary, and can be replaced by virtually any type of rotary drive mechanism, including internal and external drives. Given that the drive portion 12 is conventional, its manufacture and assembly will not be described in detail. Suffice it to say that the motor assembly 20 is assembled within the motor housing 16 and the end bell 18 and electrical housing 30 are mounted to the motor housing 16. The motor shaft 44 extends from the motor housing 16 to receive the pump portion 14.

The inboard disc 36 is fitted over the motor shaft 44 with the transfer grooves 78*a–b* facing in an outboard direction (i.e. toward the rotor assembly 40). Next, the pump casing 32 is mounted to the motor housing 16 by bolts 144 with the inboard disc 36 fitted within inboard disc recess 58. A conventional seal 142 is installed around the periphery of the inboard disc 36 between the pump casing 32 and the motor housing 16.

Next, the liner 34 is fitted within the pump casing void 50. The liner 34 is positioned such that key 66 is fitted within key opening 68. This aligns the disc with respect to the pump casing 32.

The rotor assembly 40 is assembled by installing a single vane 108*a–h* in each of the vane slots 136*a–h*. The completed rotor assembly 40 is fitted within the rotor chamber 42 and secured to the motor shaft 44 by key 150 in a conventional manner. The motor shaft 44 defines an elongated, axially extending keyway 152 that receives the key 150. The arrangement is relatively loose, thereby permitting the rotor assembly 40 to float axially along the motor shaft 44.

Finally, the outboard head 38 is installed on the outboard side of the pump casing 32 by bolts 146. The motor shaft 44 is rotatably received within shaft recess 94. A conventional seal 148 is installed between the pump casing 32 and the outboard head 38.

OPERATION

Figure 17:
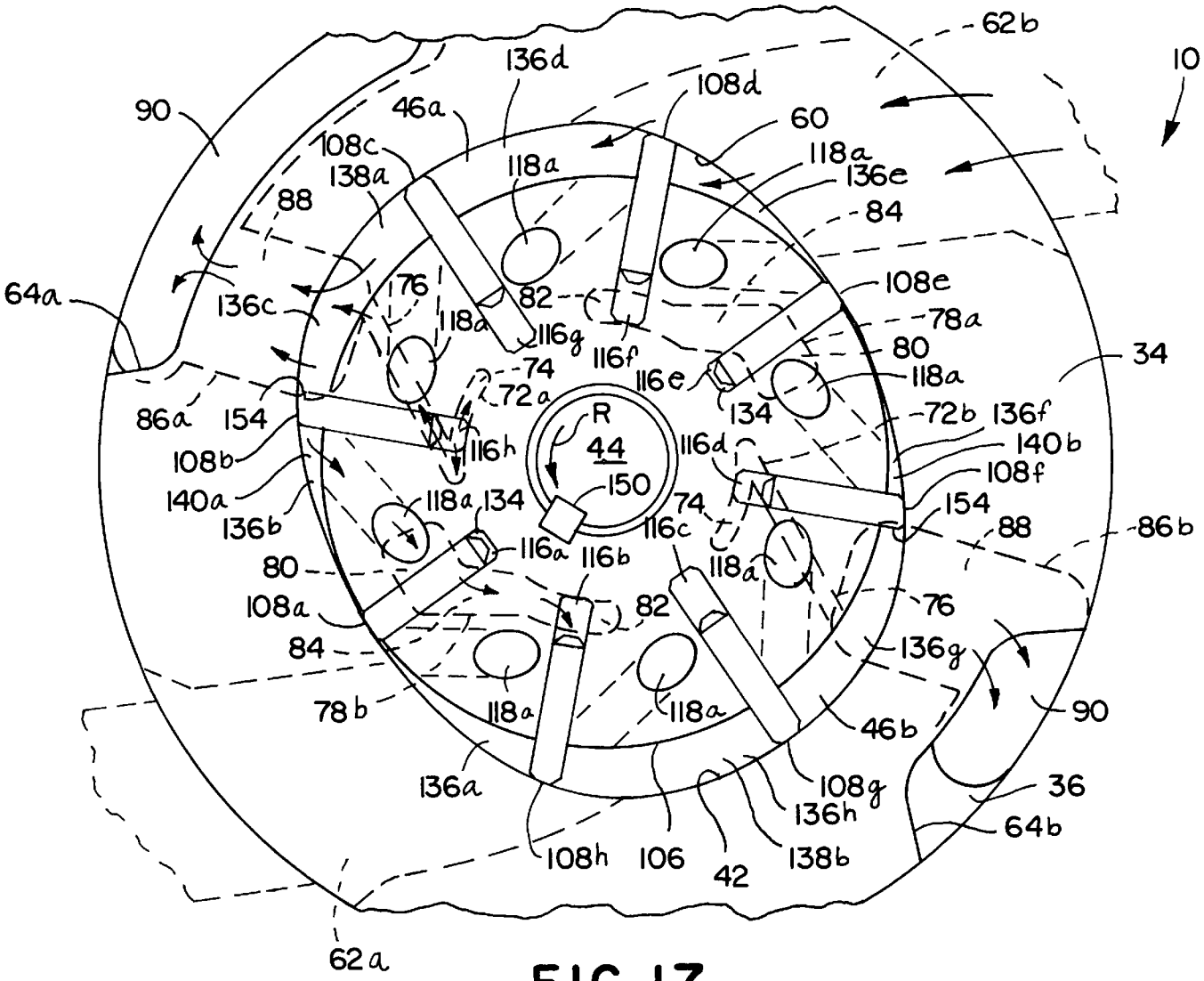
FIG. 17 is a sectional view of a portion of the pump with the rotor in a first position.
Figure 18:
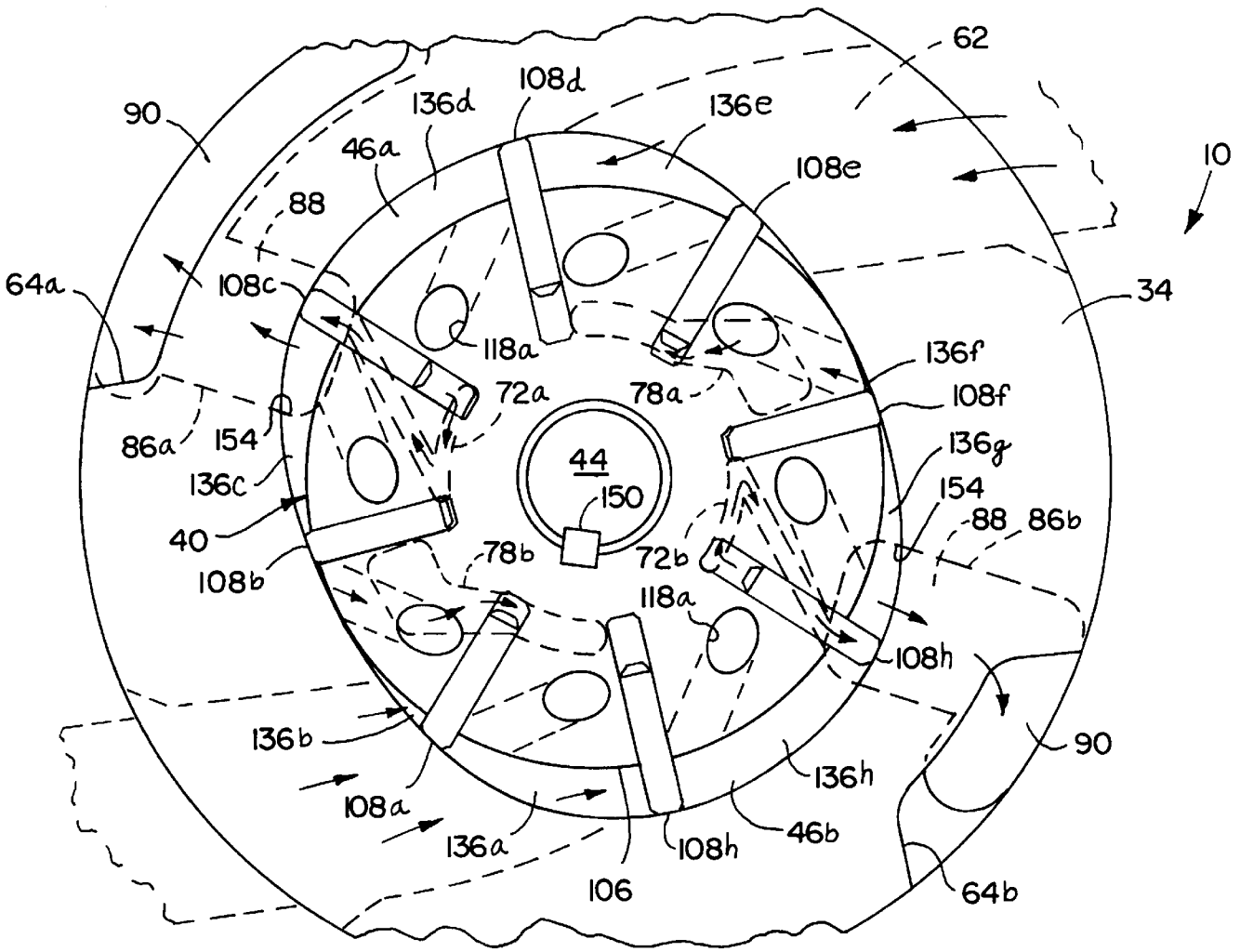
FIG. 18 is a sectional view of a portion of the pump with the rotor in a second position.

In operation, the various grooves and openings in the rotor 106, inboard disc 36, and outboard head 38 cooperate to provide fixed volume hydraulic vane actuation. The size, shape, and location of these grooves and openings are selected to provide appropriate timing for the hydraulic vane actuation. Operation of the pump 10 will be described in more detail with reference to FIGS. 17 and 18. FIG. 17 is a sectional view of a portion of the pump 10 with the outboard head 38 removed to show the interrelationship of the pumping chambers 46*a–b*, the rotor assembly 40, and the flow paths. FIG. 18 is a similar view of the pump showing the rotor assembly 40 in a different position. In these illustrations, the vent grooves 72*a–b*, transfer grooves 78*a–b*, and discharge openings 86*a–b* of the inboard disc 36 are shown in hidden lines. The corresponding elements of the outboard head 38 are axially aligned with the vent grooves 72*a–b*, transfer grooves 78*a–b*, and discharge openings 86*a–b* of the inboard disc 36 such that if the elements of the outboard head 38 were shown, they would directly overlay the elements of the inboard disc 36. The direction of rotation of the rotor assembly 40 is denoted by arrow R.

As shown, the rotor assembly 40 is centrally disposed within the rotor chamber 42 to define radially opposed pumping chambers 46*a–b*. During rotation, the vanes 108*a–h* are urged outwardly in the vane slots 116*a–h* to engage the inner surface of the liner 34. The vanes 108*a–h* function as cam followers which track along the cam-shaped wall of the liner 34 throughout their rotation. As such, the vanes 108*a–h* divide the rotor chamber 42 into a number of discrete cavities 136*a–h* that rotate with the rotor 106 constantly changing in volume due to the elliptical shape of the rotor chamber 42. In general, the cavities 136*a–h* have an expanding volume as they travel into the elongated portions of the rotor chamber 42 and a contracting volume as they travel out of the elongated portions of the rotor chamber 42.

In addition, the discharge openings 86*a–b* and discharge grooves 100*a–b* are positioned to divide each of the pumping chambers 46*a–b* into a primary chamber 138*a–b* and a secondary chamber 140*a–b*. More specifically, the primary chambers 138*a–b* are those portions of the pumping chambers 46*a–b* that lie behind (with respect to the direction of rotation of the rotor assembly) the trailing edge 154 of the discharge openings 86*a–b*, and the secondary chambers 140*a–b* are those portions of the pumping chambers 46*a–b* that lie forwardly of the trailing edge 154 of the discharge openings 86*a–b*. The purpose and function of these chambers is described below.

Operation of the prefered embodiment will be described in connection with the movement of a single cavity through a single pumping chamber. It should be recognized that operation of the present invention is identical for each cavity 136*a–h* as it moves through each pumping chamber 46*a–b*.

Each cavity is defined, in part, by a leading vane and a trailing vane. As the leading vane enters the pumping chamber, the cavity begins to expand (See FIG. 17, vanes 108*d* and 108*h*, cavities 136*a* and 136*e*, and pumping chambers 46*a–b*). As the cavity expands, a partial vacuum is created which draws pumpage into the pumping chamber through radial flow passages 62*a–b*. This flow is illustrated in FIG. 17 by arrows which show the flow of pumpage from flow passage 62*b* into pumping chambers 46*a*. As described in more detail below, the hydraulic actuation mechanism of the present invention forces pumpage into the base of the vane slot of the leading vane to push the vane out and help it remain in contact with the wall of the liner 34. Similarly, the trailing vane receives hydraulic actuation when it moves into the pumping chamber.

The cavity continues to expand and draw pumpage into the pumping chamber until its reaches the center of the pumping chamber. As the cavity moves past the center of the pumping chamber, it begins to contract causing the pressure of pumpage within the cavity to increase (See FIG. 17, cavities 136*c* and 136*g*). This increase in pressure forces the pumpage contained within the cavity to flow out of the pumping chamber through discharge openings 86*a–b* and discharge grooves 100*a–b*. This flow path is illustrated in FIG. 17 by arrows which show the flow of pumpage out of cavity 136*c* into discharge opening 86*a*. As they travel out of the elongated portion of the rotor chamber 42, the leading and trailing vanes are forced to retract into their respective vane slots (See FIG. 17, vanes 108*b–c* and 108*f–g* and vane slots 116*g–h* and 116*c–d*). Simultaneously, the vane slots come into communication with the vent grooves 72*a–b* and 98*a–b* (See FIG. 17, vane slots 116*d* and 116*h*). As the vanes retract, the pumpage forced into the vane slots by the hydraulic actuation mechanism is expelled into the arcuate segment 74. From the arcuate segment 74 the pumpage flows through the linear segment 76 and into the discharge openings 86*a–b* and discharge grooves 100*a–b*. This flow path is illustrated in FIG. 17 by arrows which show the flow of pumpage from vane slots 116*h* through vent groove 72*a* into discharge openings 86*a*.

As the contracting cavity continues to rotate, the trailing vane moves past the trailing edge 154 of the discharge openings 86*a–b* and discharge grooves 100*a–b* so that the cavity is no longer in communication with the discharge openings 86*a–b* and discharge grooves 100*a–b* (See FIG. 17, vanes 108*b* and 108*f* and cavities 136*b* and 136*f*). At this point, the cavity has moved from the primary chamber 138*a–b* to the secondary chamber 140*a–b*. Simultanesouly, the rotor transfer holes 118*a–b* of the contracting cavity come into communication with the transfer grooves 78*a–b* and 96*a–b* of the inboard disc 36 and the outboard head 38. The transfer grooves 78*a–b* and 96*a–b* in turn come into communication with the base of the vane slots 116*a–h* of an extending vane 108*a–h* (See FIG. 17, vane slots 116*b* and 116*f* and vanes 108*d* and 108*h*). As the rotor assembly 40 continues to rotate, the cavity continues to collapse forcing the remaining pumpage out of the cavity through the rotor transfer holes 118*a–b* and the transfer grooves 78*a–b* and 96*a–b* into the base of the vane slot of the extending vane. This flow path is illustrated in FIG. 17 by arrows that show the flow of pumpage from cavity 136*b* through rotor transfer hole 118*a* and transfer groove 78*b* into vane slot 116*b* beneath vane 108*h*. As can be seen, the pumpage flows from the rotor transfer hole 118*a* into the inlet portion 80 of the transfer groove 78*b*. From inlet portion 80, the pumpage flows through the central portion 84 to the outlet portion 82, and from the outlet portion 82 into the base of the vane slot 116*b*. In this manner, a fixed volume of pumpage is forced from the secondary chamber into the vane slot of an extending vane to provide increased outward force on the vane.

It should be noted that the timing and volume of the hydraulic actuation feature is controlled by the shape and location of the transfer grooves, discharge holes, discharge grooves, and rotor transfer holes. By varying the shape and location of the these elements, the volume and timing of the actuation can be readily controlled. For example, the radial position of the discharge grooves can be varied to control the volume of the secondary chamber, and consequently, the volume of pumpage used to actuate the vanes. Similarly, the respective dimensions of the inlet and outlet portions of the transfer grooves can be varied to control the time at which pumpage is supplied to the vane slot. For example, the length of the inlet portion can be reduced and the length of the outlet portion can be extended to cause pumpage to enter the vane slot earlier in its rotation.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. A sliding vane rotary pump for pumping a pumpage, comprising:

a pump housing defining a primary chamber and a secondary chamber;

a rotor assembly mounted within said housing for rotation about an axis, said rotor assembly including a rotor and a plurality of vanes carried by said rotor, said vanes adapted to move through said primary chamber and said secondary chamber as said rotor assembly rotates, said primary chamber and said secondary chamber shaped such that said vanes actuate as said rotor assembly rotates, said secondary chamber containing a fixed volume of pumpage; and fixed-volume actuation means for using said fixed volume of pumpage in said secondary chamber to actuate a vane.

2. The pump of claim 1 wherein said vanes divide said primary chamber and said secondary chamber into a plurality of cavities, said cavities adapted to expand an contract as said rotor assembly rotates.

3. The pump of claim 2 wherein said secondary chamber is shaped such that said cavities contract as said cavities move through said secondary chamber.

4. The pump of claim 3 wherein said fixed-volume actuation means includes a rotor transfer hole defined by said rotor in communication with one of said cavities and a transfer groove defined by said housing, said rotor transfer hole and said transfer groove adapted to be in communication with one another and with a vane slot of an extending vane when said cavity moves through said secondary chamber.

5. The pump of claim 1 wherein said fixed-volume actuation means includes a rotor transfer hole defined by and rotating with said rotor, said rotor transfer hole defining a flow path from a first of said cavities to an axial end of said rotor.

6. The pump of claim 5 wherein said fixed-volume actuation means further includes a stationary transfer groove defined by said housing adjacent to said axial end of said rotor, said rotor transfer hole and said stationary transfer groove adapted to be in communication with one another and with a vane slot of an extending vane when said first cavity moves through said secondary chamber.

7. The pump of claim 6 wherein said vane slots include a base and said vanes includes an inner edge, said vanes including a protrusion extending from said inner edge to provide a gap between said vanes and said base of said vane slots even when said vanes are fully retracted.

8. A rotary pump, comprising;

a housing defining a pumping chamber, said pumping chamber including a primary chamber and a secondary chamber;

a rotor assembly rotatably mounted within said housing, said rotor assembly including a rotor and a plurality of vanes, said rotor defining a plurality of vane slots, each of said vanes slidably mounted within one of said vane slots, said vanes dividing said pumping chamber into a plurality of cavities which travel through said pumping chamber as said rotor assembly rotates, each of said cavities defined by a leading vane and a trailing vane, said vanes adapted to extend and retract and said cavities adapted to expand and contract as said rotor assembly rotates within said housing, each contracting cavity containing a fixed volume of pumpage when said trailing vane of said contracting cavity enters said secondary chamber; and fixed-volume hydraulic actuation means for moving said fixed volume of pumpage from said contracting cavity into vane slots beneath an extending vane as said contracting cavity moves through said secondary chamber.

9. A rotary pump, comprising:

a housing defining a pumping chamber, said pumping chamber including a primary chamber and a secondary chamber, said housing defining a discharge, said discharge dividing said pumping chamber into said primary chamber and said secondary chamber;

a rotor assembly rotatably mounted within said housing, said rotor assembly including a rotor and a plurality of vanes, said rotor defining a plurality of vane slots, each of said vanes slidably mounted within one of said vane slots, said vanes dividing said pumping chamber into a plurality of cavities which travel through said pumping chamber as said rotor assembly rotates, said vanes adapted to extend and retract and said cavities adapted to expand and contract as said rotor assembly rotates within said housing; and fixed-volume hydraulic actuation means for moving pumpage from a contracting cavity into a vane slot beneath an extending vane as said contracting cavity moves through said secondary chamber.

10. The pump of claim 9 further comprising discharge means for moving pumpage from a contracting cavity into said discharge as said contracting cavity moves through said primary chamber.

11. The pump of claim 10 wherein said fixed-volume hydraulic vane actuation means includes a rotor transfer hole defined in said rotor.

12. The pump of claim 11 wherein said rotor includes an outer surface and a pair of axial end surfaces, said rotor transfer hole extending from said outer surface to one of said end surfaces.

13. The pump of claim 12 wherein said fixed-volume hydraulic vane actuation means includes a transfer groove defined in said housing, said transfer groove providing communication between said rotor transfer hole and said vane slot beneath said extending vane.

14. The pump of claim 13 wherein said housing includes an outboard head, said outboard head defining said transfer groove.

15. The pump of claim 13 wherein said housing includes an inboard disc, said inboard disc defining said transfer groove.

16. The pump of claim 13 wherein said housing includes an outboard head, an inboard disc, and a plurality of transfer grooves, said outboard head and said inboard disc each defining one of said transfer grooves.

17. The pump of claim 2 wherein said rotor defines a pair of rotor transfer holes, said rotor transfer holes extending between said outer surface and opposite axial ends of said rotor.

18. The pump of claim 17 wherein said fixed-volume hydraulic vane actuation means includes a vent groove defined in said housing, said vent groove permitting pumpage to vent from a vane slot of a retracting vane to said discharge.

19. The pump of claim 18 wherein said vane slots include a base and said vanes includes an inner edge, said vanes including a protrusion extending from said inner edge to provide a gap between said vanes and said base of said vane slots even when said vanes are fully retracted.

20. A pump comprising:

a housing defining a rotor chamber and a discharge; and a rotor assembly rotatably mounted within said rotor chamber, said rotor assembly dividing said rotor chamber into a pair of radially opposed pumping chambers, said discharge dividing at least one of said pumping chambers into a primary chamber and a secondary chamber, said rotor assembly including a rotor and a plurality of vanes, said rotor defining a plurality of vane slots each slidably receiving one of said vanes, said vanes dividing said rotor chamber into a plurality of distinct cavities which rotate with said rotor and travel through said pumping chambers, said cavities adapted to expand and contract and said vanes adapted to extend and retract as said rotor rotates; and a flow path from said secondary chamber to a vane slot of an extending vane whereby pumpage from a contracting cavity moving through said secondary chamber moves from said secondary chamber into said vane slot of said extending vane.

21. The pump of claim 20 further comprising discharge means for moving pumpage from a contracting cavity into said discharge as said contracting cavity moves through said primary chamber.

22. The pump of claim 21 wherein said flow path includes a rotor transfer hole defined in said rotor.

23. The pump of claim 22 wherein said rotor includes an outer surface and a pair of axial end surfaces, said rotor transfer hole extending from said outer surface to one of said end surfaces.

24. The pump of claim 23 wherein said flow path includes a transfer groove defined in said disc, said transfer groove providing communication between said rotor transfer hole and said vane slot beneath said extending vane.

25. The pump of claim 24 wherein said housing includes an outboard head, said outboard head defining said transfer groove.

26. The pump of claim 24 wherein said housing includes an inboard disc, said inboard disc defining said transfer groove.

27. The pump of claim 24 wherein said housing includes an outboard head, an inboard disc, and a plurality of transfer grooves, said outboard head and said inboard disc each defining one of said transfer grooves.

28. The pump of claim 27 wherein said rotor defines a pair of rotor transfer holes, said rotor transfer holes extending between said outer surface and opposite axial ends of said rotor.

29. The pump of claim 28 wherein said flow path includes a vent groove defined in said housing, said vent groove permitting pumpage to vent from a vane slot of a retracting vane.

30. The pump of claim 29 wherein said vent groove interconnects said vane slot of said retracting vane with said discharge to permit pumpage to vent from said vane slot of said retracting vane to said discharge.

* * * * *